US006499607B1

(12) United States Patent
Fijalkowski et al.

(10) Patent No.: US 6,499,607 B1
(45) Date of Patent: Dec. 31, 2002

(54) DEVICE FOR STORING VEHICLE WHEELS

(75) Inventors: Georg Fijalkowski, Bad Dürrhelm; Oskar Harsch, Villingen-Schwenningen, both of (DE)

(73) Assignee: Reifenspinne GmbH (DE)

( * ) Notice: Subject to any disclaimer, the term of this patent is extended or adjusted under 35 U.S.C. 154(b) by 0 days.

(21) Appl. No.: 09/743,817

(22) PCT Filed: Jul. 14, 1999

(86) PCT No.: PCT/EP99/04993

§ 371 (c)(1),
(2), (4) Date: Jan. 16, 2001

(87) PCT Pub. No.: WO00/03630

PCT Pub. Date: Jan. 27, 2000

(30) Foreign Application Priority Data

Jul. 14, 1998 (DE) ..... 198 31 476

(51) Int. Cl.[7] ..... A47F 7/04
(52) U.S. Cl. ..... 211/23
(58) Field of Search ..... 211/23, 24; 414/426

(56) References Cited

U.S. PATENT DOCUMENTS 4,007,863 A * 2/1977 Norris ..... 224/42.24
5,664,687 A * 9/1997 Liatti ..... 211/17
6,095,344 A * 8/2000 White ..... 211/17

FOREIGN PATENT DOCUMENTS

FR 1354317 * 1/1964 ..... 211/23

* cited by examiner

*Primary Examiner*—Steven A. Bratlie
(74) *Attorney, Agent, or Firm*—Pendorf & Cutliff

(57) ABSTRACT

Device for securing multiple vehicle wheels or vehicle tires, having a base unit adapted for being secured to a ceiling or a wall of a building; at least pair of one receiving elements, each receiving element connected to the base unit and has a longitudinal axis, each longitudinal axis oriented 90° from each other; and at least one mounting element associated with each receiving element, wherein each mounting element is the form of a longitudinally extending mounting arm and including a first end and a second end, wherein each mounting element is connected at the first end to the receiving element, and the second end to mounting device, the mounting element device adapted to hold the wheels or tires; each mounting element is independently pivotably connected to the corresponding receiving element between a receiving position and a storage position; each mounting element is independently lockable in the storage position via a locking device; and each mounting device extending perpendicular from the corresponding mounting element.

12 Claims, 7 Drawing Sheets

DEVICE FOR STORING VEHICLE WHEELS

BACKGROUND OF THE INVENTION

1. Field of the Invention

The present invention concerns a device for storing vehicles wheels. A device of this type is known from G 93 17 025.4. This device, also referred to as a tire tree, includes a base unit in the form of a pedestal or stand, and a stand column. The stand column includes carrier arms located at the right angles to the stand column and parallel to the stand feet. These carrier arms serve to receive vehicle wheels or vehicle tires, which can be hung up on the carrier arms in simple manner.

2. Description of the Related Art

This known device makes possible a desirable protective storage of the vehicle wheels or vehicle tires, but unfortunately, there are, several disadvantages associated therewith. These include the large space requirement as a consequence of the footprint area, and particularly during unloading of the carrier arms. Besides this, there is the danger that the device, if loaded on only one side, could tip over, for example, during the changing out of tires.

SUMMARY OF THE INVENTION

The present invention is thus concerned with the task of providing a device of the above-described type, which has a particularly minimal space requirement and, at the same time, provides a problem-free operation.

This task is solved by a device for use in this field and having the distinguishing characteristics of claim 1.

The invention is based upon the idea of having a base unit that it can be mounted on a ceiling or even on a wall of a building. Therewith, for example, the ceiling of a garage can be utilized for storage of the vehicle wheels or vehicle tires, and the hitherto conventional standing room is no longer required. Besides this, the invention envisions that the respective mounting arms are designed to be pivotable relative to the base, wherein the range of pivot is defined as that between a receiving position and a storage position. The mounting arms can be locked in the storage position via a locking device.

The pivotable connection of the mounting arms to the base unit makes possible an exceptionally convenient manipulation of the vehicle wheels or vehicle tires during the mounting or, as the case may be, removal. For example, in the case of the present invention being mounted to a ceiling, the mounting arms can be folded down. The mounting arms, when properly dimensioned, are situated in such a height as to be conveniently accessible.

In the storage position, the mounting arms, with vehicle wheels secured thereto, are provided close below the ceiling and thus require little space in the garage floor. The loss in ceiling height in the area of the device is not disadvantageous in most cases, so that the storage of the vehicle wheels does not reduce the useful space in the garage.

The locking mechanisms can be comprised of linch pins, eccentric levers, removable and replaceable stay rods, or of detent devices. These simple construction components make possible a secure and rapid fixing of the mounting arms in the storage position.

A technically particularly simple design of the device is possible, when the mounting means respectively include a threaded rod associated with the second end of the carrier arms, on which the vehicle wheel can be secured with at least one threaded nut. In the folded down receiving position of the support device, the respective vehicle wheel can easily be slid upon the threaded rod and be secured by means of the threaded nut.

Although the application of only one threaded nut is sufficient for securing the vehicle wheel, it is of advantage, to provide further a threaded nut, which secures the vehicle wheel on the side opposite to the first threaded nut. Thereby, the vehicle wheel is tightly tensioned in and cannot undergo any tilting movement.

Depending upon the size and design of the hub opening, it can be of advantage to secure the vehicle wheel not directly via the threaded nut on the threaded rod, but rather to provide a retaining disc, which can be secured to at least one bolt of the vehicle wheel and which exhibits an opening oriented concentric with the hub opening of the vehicle wheel, through which the threaded rod can be introduced. In this case, first the retaining disk is mounted onto the vehicle wheel, which thereafter, together with the mounted retaining disc, is slid onto the threaded rod. The threaded nut then does not support itself directly upon the vehicle wheel, but rather upon the retaining disc. In order to fit various lug nut pattern diameters of vehicle wheels, the holding disc is provided with a radially extending elongated hole, which covers the ranges of the various hole pattern diameters.

Since the threaded rod extends through the hub opening of the vehicle wheel, it is possible during inappropriate use of the device, for example, by over tightening of the threaded nut, to cause damage to the hub opening. This applies particularly in the case of aluminum wheels, since the aluminum alloys are significantly softer than steel alloys. In order to avoid this, it is of advantage to provide safety or protective elements, which support themselves against the vehicle wheel.

According to a preferred variant, the protective elements are provided in the form of pot-shaped cover caps, which can be introduced upon the threaded rod. These are particularly suited for use in combination with the above-described retaining discs, so that the vehicle wheel is securely received between the cover cap and the retaining disc.

An alternative embodiment of the protective element envisions a cone shaped, hollow cover cap, of which the section with the larger diameter engages the vehicle wheel on the side opposite to the mounting arm, and of which the section with the smaller diameter can be introduced through the hub opening of the vehicle wheel.

This embodiment, as a result of the conical contour, makes possible an automatic, optimal fitting to the respective geometry of the hub opening, whereby the vehicle wheel is constantly centered. Besides this, in the case of the use of two conical-shaped cover caps of this type, an optimal adaptation or fitting to vehicle wheels of the most diverse breadth and design can be undertaken. The cover caps can, depending upon circumstances, either be oriented in the same direction or in opposite directions.

These alternative embodiments of the protective elements offer additionally the possibility of integrating the threaded nut in the respective smaller diameter segments. This also enables, for example, the exact positioning of the cover cap upon the threaded rod.

Although a large number of embodiments are possible for the mounting arms, it is of advantage for weight and stability reasons, when the mounting arms are formed as U-shaped arms and are connected to the base unit via pivot pins.

Preferably, each mounting arm is provided with multiple receptacles for the selective positioning of the threaded rod.

Therewith, an optimal adjustment of the device to conform to the respective wheel diameter to be mounted can occur.

In wheels of smaller diameter, the threaded rods can be positioned relatively far inwardly, so that the total surface area on the surface upon which the inventive device is mounted, that is, for example, the ceiling, is kept to a minimum.

Since the vehicle wheels are generally relatively heavy, it could pose a problem, in particular, for weaker persons, to pivot the downwardly folded, vehicle wheel carrying mounting arms back into their storage position. This can be aided by a suitably positioned spring device.

A form-fitting design for mounting on the surface is made possible when the base unit is designed as a base plate with receptacle elements for the mounting arms. In this case, the base unit can be screw-fastened directly onto the building ceiling via the base plate.

One alternative envisions that the base unit is comprised of two essentially congruent segments of U-shaped profile. On the one hand, such profile segments are simple and economical to produce, wherein the selected profile shape makes possible an optimal connecting of the mounting arms, for example via pivot bolts. On the other hand, this two-part embodiment makes possible the selective provisioning of a single device for the collective storage of, for example, four wheels or, alternatively, the separate mounting of respectively two wheels, which could be of advantage for example in an environment of a very narrow space.

BRIEF DESCRIPTION OF THE DRAWINGS

Further advantages and characteristics of the present invention can be seen from the following description of various exemplary embodiments as well as from the drawings, to which reference is made. There is shown.

DETAILED DESCRIPTION OF THE INVENTION

Figure 1:
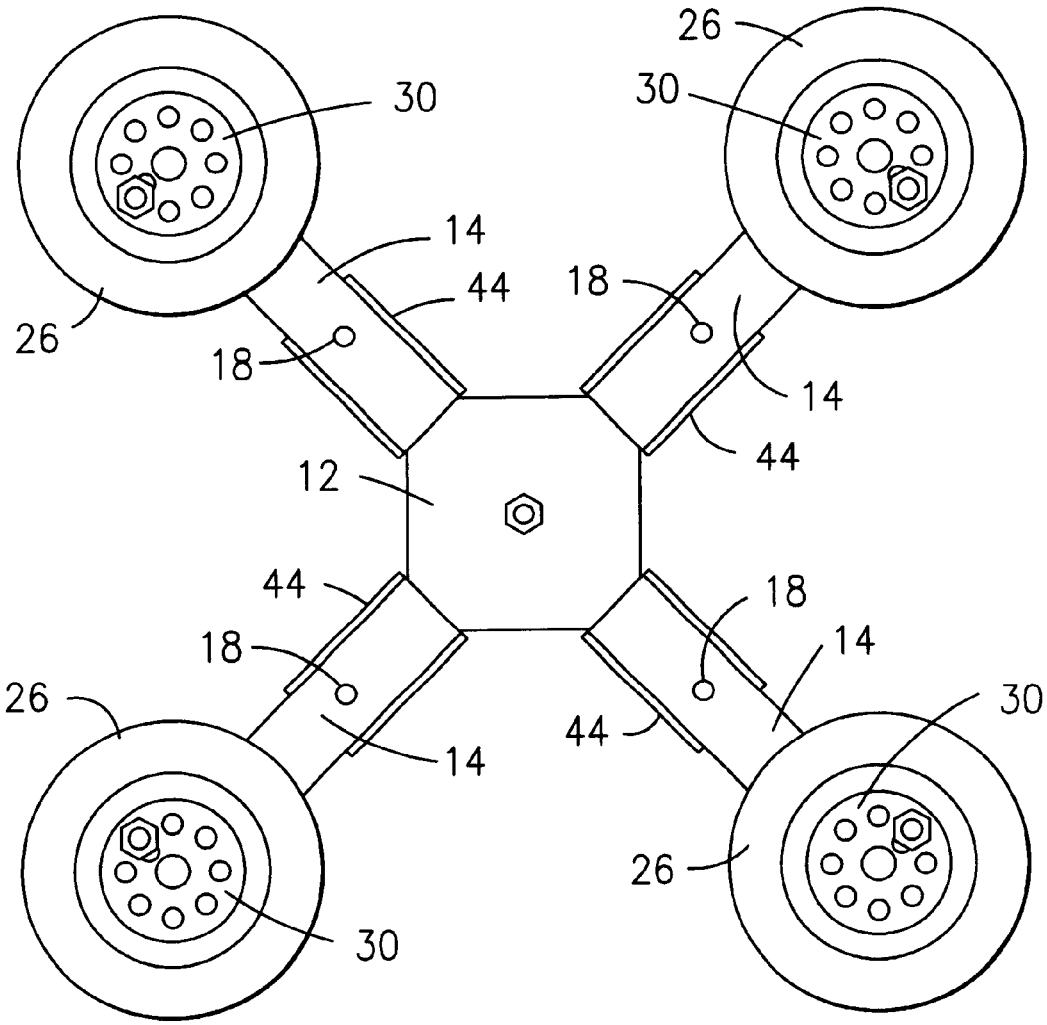
FIG. 1 shows a top view upon the device according to a first embodiment, in storage position.
Figure 2A:
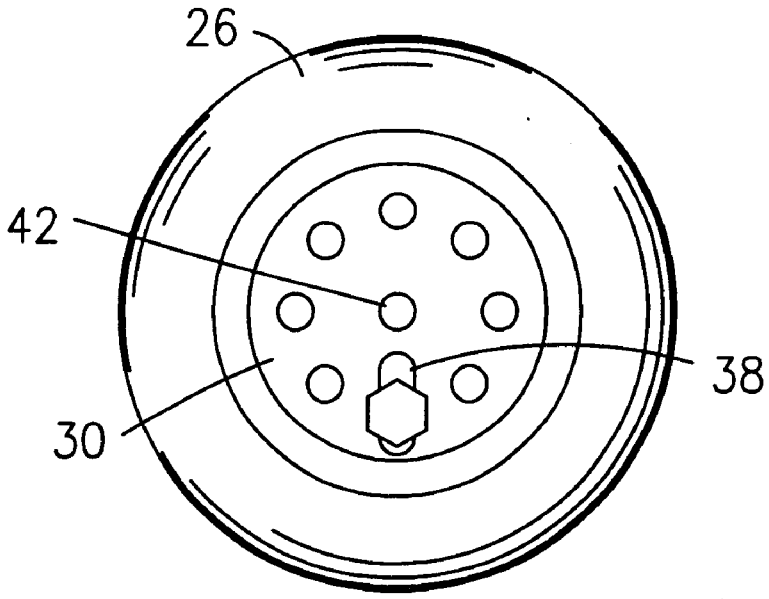
FIG. 2A shows a side view of a vehicle wheel with pre-mounted retaining plate.
Figure 2B:
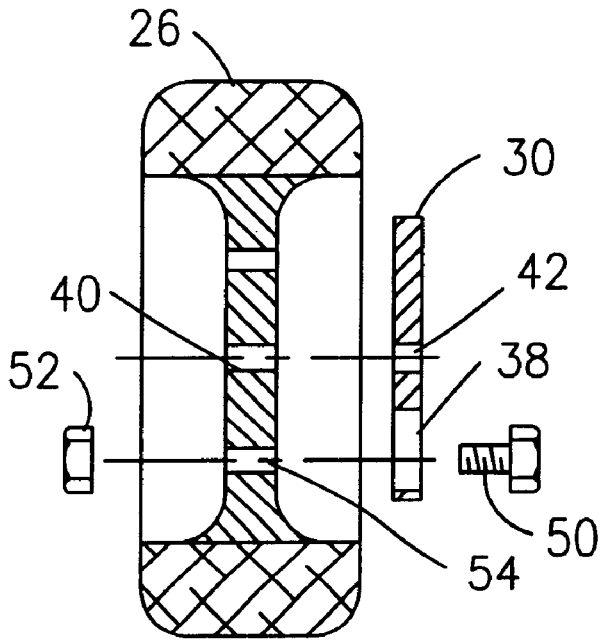
FIG. 2B shows a transverse sectional view through this vehicle wheel prior to the installation of the retaining plate.
Figure 3A:
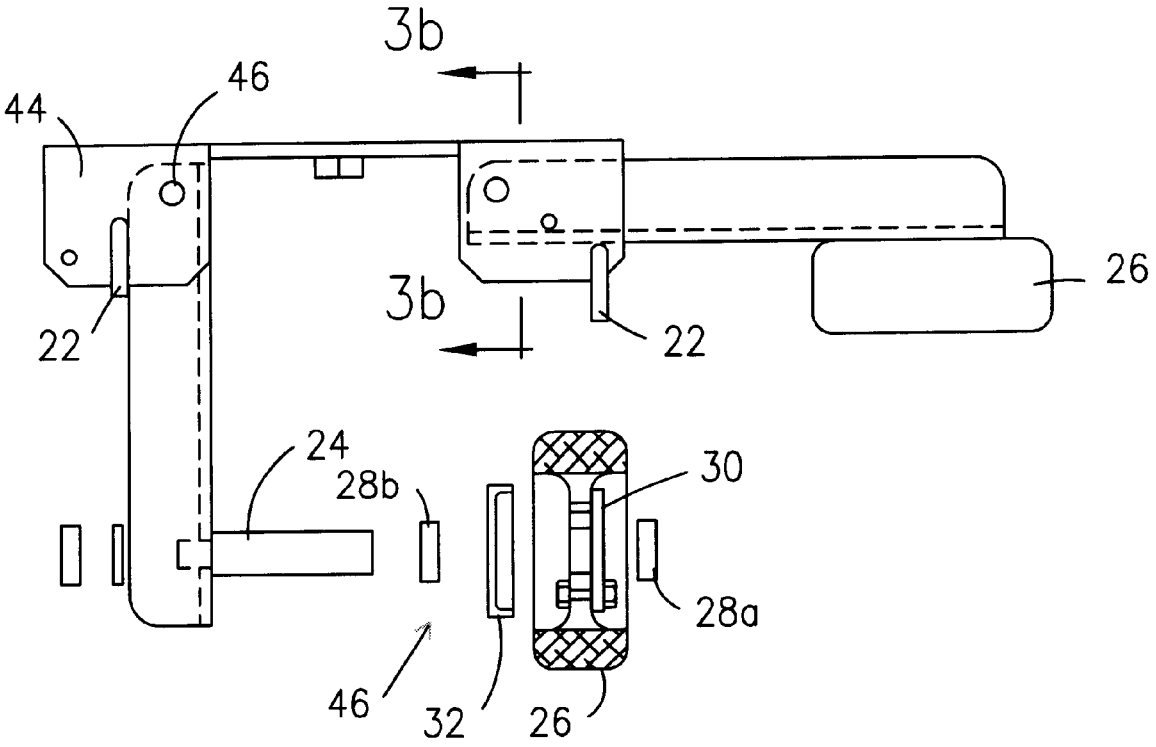
FIG. 3A shows a side view of the device according to FIG. 1, wherein a mounting arm ready for receiving a vehicle wheel is folded down, and a mounting arm is already pivoted up into the storage position.
Figure 3B:
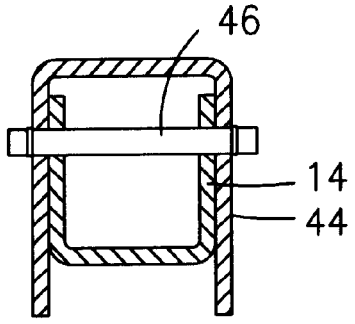
FIG. 3B shows a cross-section along lines A—A of FIG. 3A.

A first embodiment of the device 10 for storage of vehicle wheels 26 or vehicle tires is described on the basis of FIGS. 1–3. The device 10 includes a base unit in the shape of a base plate 12, which can be secured to a building ceiling.

Although the base plate 12 can take various shapes, it is shown in the illustrative embodiment in essentially square shape. The base plate exhibits receiving elements 44 at each respective corners, which have a U-shaped cross section. Free shanks extend essentially perpendicular to the plane of the base plate 12 and, in the mounted condition of the device 10, are directed downwardly.

Mounting arms in the shape of arms 14 are received in these four receiving elements 44 and are pivotably connected to these receiving elements 44 via pivot pins 46.

The arms 14 likewise exhibit an U-shaped cross section, wherein in the shown embodiment, the arms 14 are provided within the shanks of the receiving elements 44.

For securing a vehicle wheel 26 onto the the arms 14, threaded rods 24 are secured to the free ends of the arms 14, which run essentially perpendicular to the arms 14.

These threaded rods 24 have a diameter, which makes it possible to slide all of the various vehicle wheels, with varying hub openings 40, upon this threaded rod 24.

In order to secure a vehicle wheel 26 upon the threaded rod 24, it is sufficient to lock the vehicle wheel 26, after introduction on the rod using a threaded nut 28*a*. Thereby, the side of the vehicle wheel 26 opposite to the threaded nut 28*a* lies against the arm 14.

By screwing of a further threaded nut 28*b* upon the threaded rod 24, the seating depth, or as the case may be, the axial position of the vehicle wheel 26, can be predetermined or preadjusted, so that the threaded nut 28*a* need only travel a shorter path for pulling tight of the vehicle wheel. The threaded nut 28*b* thereby counters the vehicle wheel 26.

In order to completely rule out the damaging of the hub opening 40, the device 10 includes in accordance with a first embodiment a retaining disc 30 and a securing element between which the vehicle wheel 26 can be received, so that the threaded nuts 28*a* and 28*b* no longer come into direct connection with the vehicle wheels.

As can be seen from FIGS. 2 and 3A, the retaining disc 30 is so constructed, that it can be secured on the side of the vehicle wheel 26 opposite to the threaded rod 24. The securing of this retaining disc 30 occurs via a bolthole 54 of the vehicle wheel 26 using a bolt 50 and a nut 52.

For various hole circle pattern diameters, the retaining disc 30 exhibits a radially extending elongate hole 38 so that one opening 42 of the retaining disc 30 can always be oriented co-axially with the hub hole 40.

On the opposite side of the vehicle wheel 26 a securing element is provided in the form of a cover cap 32. This cover cap 32 is shaped pot-like, wherein the opened side faces toward the vehicle wheel 26.

A particularly simple operation of the device can be seen, for example from FIG. 3A. The left half of the device 10 represents the receiving position, while the right half symbolizes the storage position.

The arms 14 can be folded down to allow the mounting of the vehicle wheels 26 at an ergonomic working height. For storage, the arms 14 are pivoted upwards and fixed via a suitable locking mechanism 18. It is, however, also possible for the downward folded arms 14 to be designed so as also to be fixable, since thereby the introduction of the vehicle wheels 26 would be facilitated, since the arms 14 could no longer pivot away upon contact.

Figure 3C:
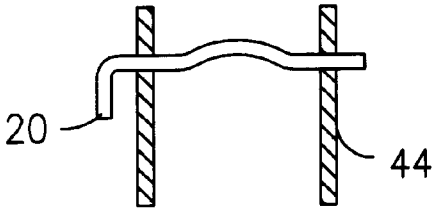
FIG. 3C shows a cross-sectional view through a receiving element having a linch pin.

The locking mechanism 18 can be comprised of a locking pin 20 as shown in FIG. 3C, a removable and replaceable securing rod 22 as shown in FIG. 3A, or of a not shown detent mechanism. As shown in FIG. 3A, either the linch pin 20 or the securing element 22 can be removed and relocated, in order to fix the arm 14 in the two positions.

As shown in FIG. 3C, the linch pin 20 is bowed in the center in the manner of an eccentric or cam. Thereby, it becomes possible, during the fixing of the mounting arms 14 in the folded-up condition, to take out any slack which may be present, and to press the mounting arm 14 tightly against the receiving element 44.

Via a spring device, which is not illustrated in detail, the pivot movement of the arm 14 can be assisted or biased, so that even weaker persons are capable of operating this device.

Although only vehicle wheels 26 are mentioned in the described embodiments, it is of course possible, using suitable retaining means, to also store vehicle tires with the inventive device in space-saving manner.

Figure 4:
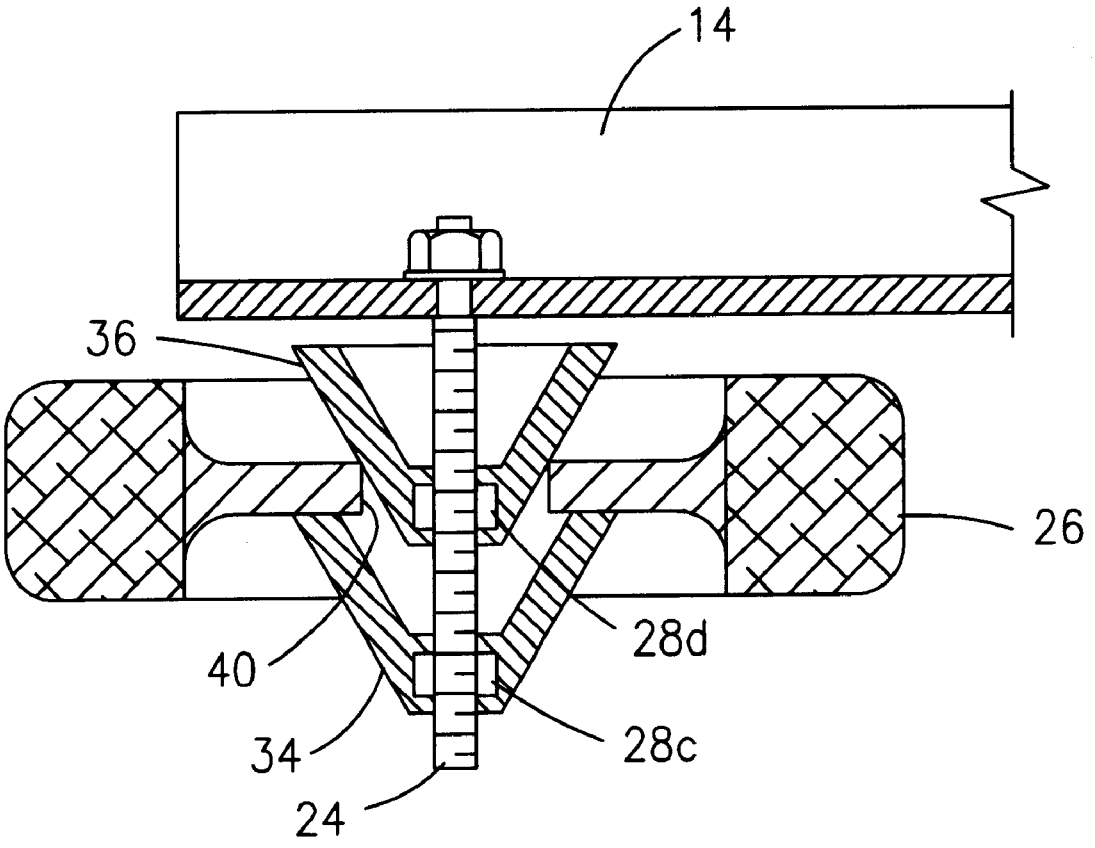
FIG. 4 shows a cross-section through a mounting arm with attached vehicle wheel according to a second embodiment.
Figure 5A:
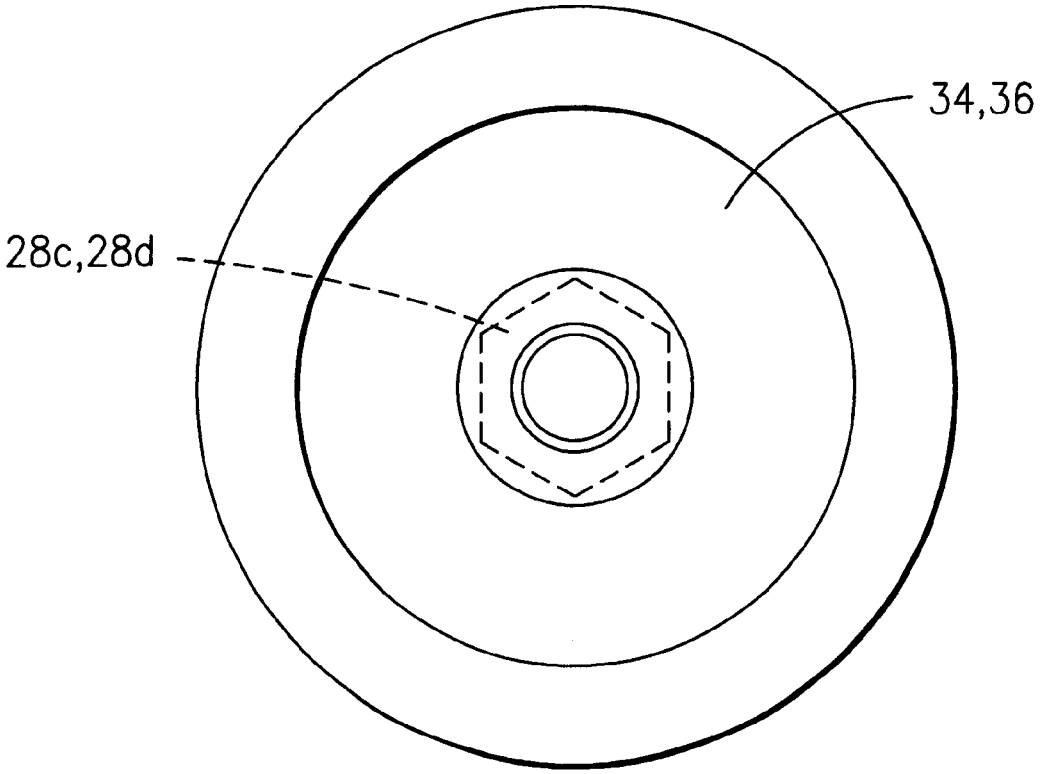
FIG. 5A shows a bottom view.
Figure 5B:
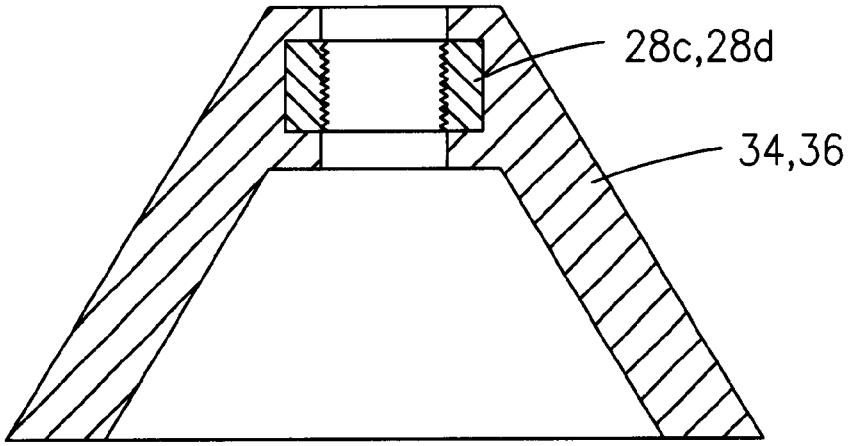
FIG. 5B shows a cross-section through a cone-shaped protective element.
Figure 6A:
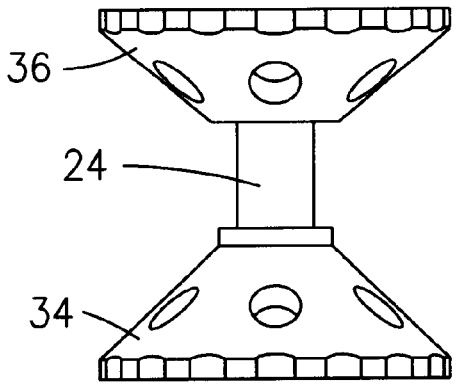
FIGS. 6A, B, and C show various variations of cone-shaped mounting means.

In FIGS. 4, 5, and 6 alternative embodiments or, as the case may be, arrangements, of protective elements are shown in the form of cone-shaped hollow cover caps 34, 36.

According to FIG. 4, two cover caps 34, 36 are provided oriented in the same direction. The upper cover cap 36 faces the arm 14 and extends through the hub hole 40 of the vehicle wheel 26, the lower cover cap 34 supports the vehicle wheel 26 with it's larger-diameter end. The cone shape is herein so selected, that on the one hand it can extend through the hub holes 40 over the entire range of possible diameters, so that a secure contacting of the hub hole 40 is always achieved. On the other hand, the maximal diameter must be selected to be sufficiently large, that a secure supporting of the vehicle wheel 26 is guaranteed.

Securing of the cover cap 34, 36 occurs via the threaded nut 28*c* and 28*d*, which in the present case is integrated in the cover caps 34, 36. Insofar as the cover caps 34, 36 are constructed of plastic, the threaded nuts 28*c*, 28*d* can be cast unitarily therewith in the manufacturing process.

Therewith, there results a secure and inseparable connection of the threaded nuts 28*c*, 28*d* to the cover caps 34, 36 as schematically represented in FIG. 5.

FIG. 6 shows various possibilities of the application or introduction of the cover caps 34, 36 on the threaded rods 24.

Figure 6B:
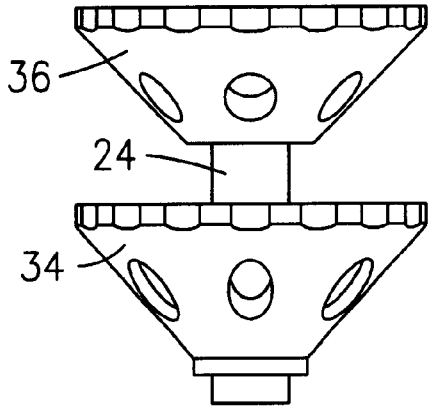

FIG. 6B corresponds to the above-described same-direction orientation of the two cover caps 34, 36. In contrast thereto, the cover caps 34, 36 according to 6A are provided on the threaded rod 24 in opposite directions.

Figure 6C:
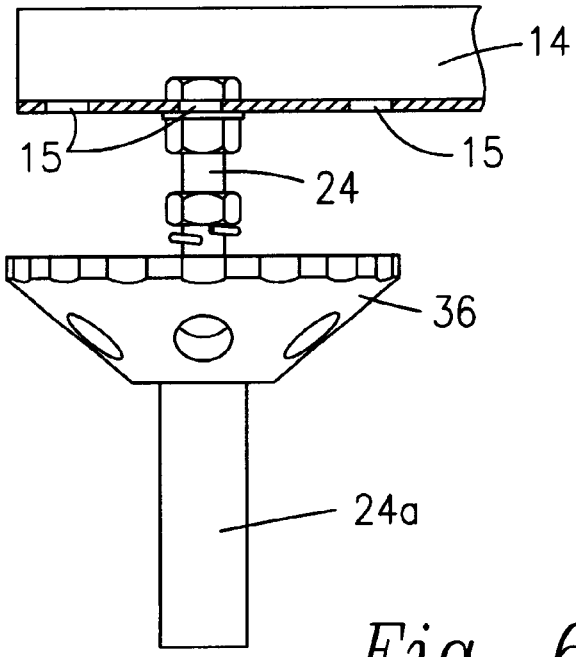
Figure 7A:
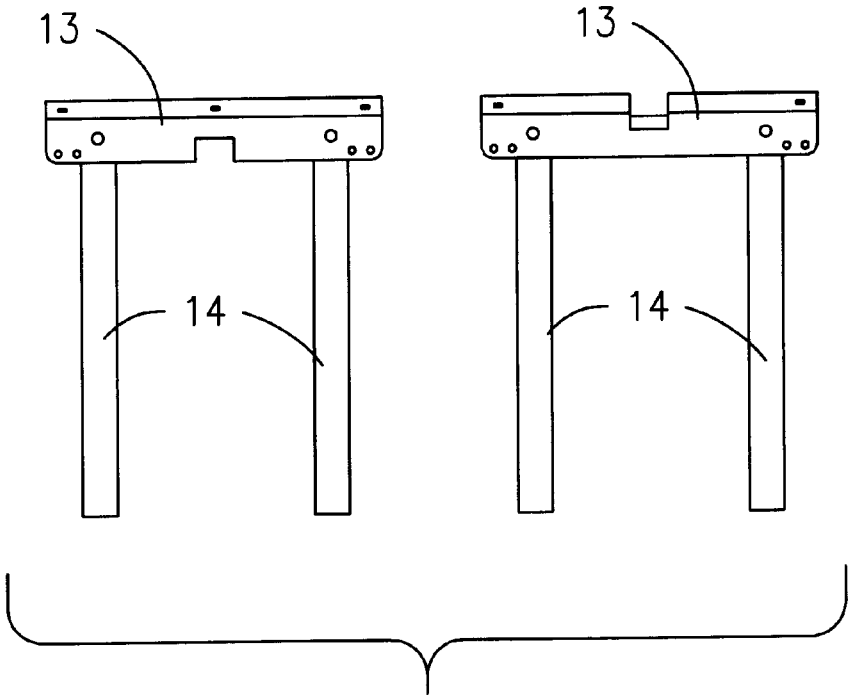
FIGS. 7A and B show a variation of the device, in which the base unit is constructed in two parts, an individual part representation, and a representation as an assembled construction.
Figure 7B:
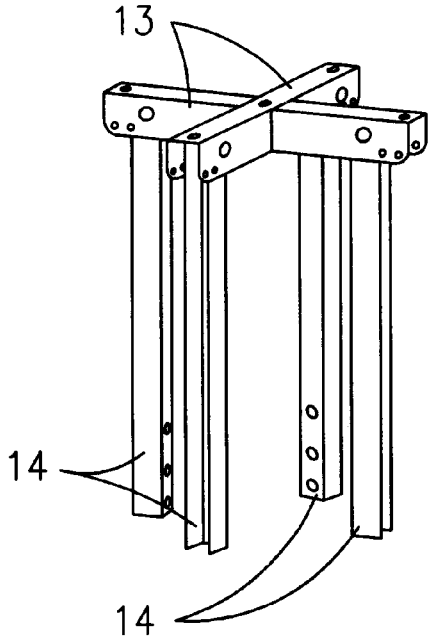

FIG. 6C shows on the one hand the possibility of positioning the threaded rods 24 at various positions on the arm 14. For this, the arm 14 exhibits bore holes 15 positioned spaced apart from each other, in which the threaded rods 24 can be introduced selectively.

A further modification of the embodiment according to FIG. 6C concerns a supplemental threaded rod 24*a*, which can be screwed onto the threaded rod 24. This alternative makes possible an optimal height adaptation, or as the case may be, positioning of the vehicle wheel 26 relative to the arm 14.

What is claimed is:

1. A device for securing multiple vehicle wheels or vehicle tires, and comprising:

a base unit adapted for being secured to a ceiling or a wall of a building;

at least pair of one receiving elements, each receiving element connected to the base unit and has a longitudinal axis, each longitudinal axis oriented 90° from each other; and at least one mounting element associated with each receiving element, wherein each mounting element is the form of a longitudinally extending mounting arm and including a first end and a second end, wherein each mounting element is connected at the first end to the receiving element, and the second end to mounting means, the mounting means adapted to hold the wheels or tires;

wherein each mounting element is independently pivotably connected to the corresponding receiving element between a receiving position and a storage position;

wherein each mounting element is independently lockable in the storage position via a locking device; and wherein each mounting means extend perpendicular from the corresponding mounting element.

2. A device (10) according to claim 1, wherein the locking device is selected from a group consisting of a linch pin (20), and eccentric lever (21), a removable and replaceable rod (22), and a detent mechanism.

3. A device (10) according to claim 1, wherein the mounting means (16) includes one threaded rod (24) connected to the second end of each of the mounting arms (14) respectively, on which threaded rod (24) the vehicle wheel (26) is securable via at least one threaded nut (28*a*; 28*c*).

4. A device (10) according to claim 3, including a further threaded nut (28*b*; 28*d*), which counters the vehicle wheel (26) from the opposite side.

5. A device (10) according to claim 3, further including a retaining disc (30) with a radially extending elongated hole (38) which can be positioned over at least one bolt hole of the vehicle wheel (26), and with an opening (42) dimensioned to being oriented concentric with the hub opening (40) of the vehicle wheel (26) when said radially extending elongate hole (38) is positioned over said bolt hole of the vehicle wheel, through which opening (42) the threaded rod (24) can be introduced.

6. A device (10) according to claim 3, further including protective elements (32, 34, 36), which support against the vehicle wheel (26).

7. A device (10) according to claim 6, wherein said protective elements are selected from the group consisting of a pot-shaped cover cap (32), which can be introduced or seated upon the threaded rod (24), and a cone-shaped, hollow cover cap (34), of which the side with the larger diameter is dimensioned to lie against the vehicle wheel or of which the segment with smaller diameter is dimensioned to extend through the hub hole (40) of the vehicle wheel (26).

8. A device (10) according to claim 7, wherein the threaded nuts (28*c*, 28*d*) are retained in the corresponding smaller diameter segment of the cone shaped cover cap (34, 36).

9. A device (10) according to claim 1, wherein the mounting arms are constructed as U-shaped arms (14) and are pivotable via pivot pins (46).

10. A device (10) according to claim 3, wherein the mounting arms (14) include multiple receptacles (15) for selective positioning of the threaded rod (24).

11. A device (10) according to claim 1, wherein the base unit is designed as a base plate (12) with receptacle elements (44) for the mounting arms (14).

12. A device (10) according to claim 1, wherein the base unit is comprised of two essentially congruent U-shaped profile segments (13).

* * * * *